US008002028B2

(12) United States Patent
Swietlik et al.

(10) Patent No.: US 8,002,028 B2
(45) Date of Patent: Aug. 23, 2011

(54) HYDRAULIC CONNECTOR APPARATUSES AND METHODS OF USE WITH DOWNHOLE TUBULARS

(75) Inventors: George Swietlik, Lowestoft (GB); Robert Large, Lowestoft (GB)

(73) Assignee: Pilot Drilling Control Limited, Lowestoft, Suffolk (GB)

( * ) Notice: Subject to any disclaimer, the term of this patent is extended or adjusted under 35 U.S.C. 154(b) by 213 days.

(21) Appl. No.: 12/368,199

(22) Filed: Feb. 9, 2009

(65) Prior Publication Data

US 2009/0205837 A1 Aug. 20, 2009

Related U.S. Application Data

(63) Continuation-in-part of application No. 11/703,915, filed on Feb. 8, 2007, now Pat. No. 7,690,422.

(30) Foreign Application Priority Data

| | | |
|---|---|---|
| Feb. 8, 2006 | (GB) | 0602565.4 |
| Feb. 8, 2008 | (GB) | 0802406.9 |
| Feb. 8, 2008 | (GB) | 0802407.7 |
| Mar. 20, 2008 | (GB) | 0805299.5 |

(51) Int. Cl.
*E21B 19/00* (2006.01)

(52) U.S. Cl. ..... 166/90.1; 166/85.1; 166/380; 166/381

(58) Field of Classification Search ..... 166/380, 166/381, 77.51, 85.1, 90.1
See application file for complete search history.

(56) References Cited

U.S. PATENT DOCUMENTS

| | | | | |
|---|---|---|---|---|
| 2,748,871 | A | 6/1956 | Brown | |
| 3,120,272 | A | 2/1964 | Cochran | |
| 3,874,634 | A | 4/1975 | Gazda | |
| 4,364,407 | A | 12/1982 | Hilliard | |
| 4,377,179 | A | 3/1983 | Giebeler | |
| 4,495,073 | A * | 1/1985 | Beimgraben | 210/448 |
| 4,625,755 | A | 12/1986 | Reddoch | |
| 4,658,905 | A | 4/1987 | Burge | |
| 4,997,042 | A | 3/1991 | Jordan et al. | |
| 5,133,419 | A | 7/1992 | Barrington | |
| 5,191,939 | A | 3/1993 | Stokley | |
| 5,501,280 | A | 3/1996 | Brisco | |

(Continued)

FOREIGN PATENT DOCUMENTS

EP 0692345 A1 1/1996

(Continued)

OTHER PUBLICATIONS

International Search Report for Patent Application No. PCT/GB2010/000229, dated Apr. 6, 2010 (14 pages).

(Continued)

*Primary Examiner* — Giovanna C Wright
(74) *Attorney, Agent, or Firm* — Osha • Liang LLP

(57) ABSTRACT

A hydraulic connector to provide a fluid tight connection between a fluid supply and a downhole tubular includes an engagement assembly configured to extend and retract a seal assembly disposed at a distal end of the hydraulic connector into and from a proximal end of the downhole tubular, and a valve assembly operable between an open position and a closed position, wherein the valve assembly is configured to allow the fluids to communicate between the fluid supply and the downhole tubular through the seal assembly when in the open position, and wherein the valve assembly is configured to prevent fluid communication between the fluid supply and the downhole tubular when closed position.

27 Claims, 10 Drawing Sheets

U.S. PATENT DOCUMENTS

| | | | |
|---|---|---|---|
| 5,584,343 | A | 12/1996 | Coone |
| 5,682,952 | A | 11/1997 | Stokley |
| 5,735,348 | A | 4/1998 | Hawkins, III |
| 5,890,538 | A | 4/1999 | Beirute et al. |
| 5,918,673 | A | 7/1999 | Hawkins et al. |
| 5,971,079 | A | 10/1999 | Mullins |
| 6,173,777 | B1 | 1/2001 | Mullins |
| 6,279,654 | B1 | 8/2001 | Mosing et al. |
| 6,390,190 | B2 | 5/2002 | Mullins |
| 6,415,862 | B1 | 7/2002 | Mullins |
| 6,460,620 | B1 | 10/2002 | LaFleur |
| 6,571,875 | B2 | 6/2003 | Bissonnette et al. |
| 6,571,876 | B2 | 6/2003 | Szarka |
| 6,578,632 | B2 | 6/2003 | Mullins |
| 6,604,578 | B2 | 8/2003 | Mullins |
| 6,666,270 | B2 | 12/2003 | Vann |
| 6,675,889 | B1 | 1/2004 | Mullins et al. |
| 6,715,542 | B2 | 4/2004 | Mullins |
| 6,722,425 | B2 | 4/2004 | Mullins |
| 6,732,804 | B2 | 5/2004 | Hosie et al. |
| 6,779,599 | B2 | 8/2004 | Mullins et al. |
| 6,883,605 | B2 | 4/2005 | Arceneaux et al. |
| 7,028,769 | B2 | 4/2006 | Mullins |
| 7,096,948 | B2 | 8/2006 | Mosing et al. |
| 7,690,422 | B2 | 4/2010 | Swietlik et al. |
| 2002/0129934 | A1 | 9/2002 | Mullins et al. |
| 2005/0000695 | A1 | 1/2005 | LaFleur |
| 2005/0173154 | A1 | 8/2005 | Lesko |

FOREIGN PATENT DOCUMENTS

| | | | |
|---|---|---|---|
| EP | 1019614 | A1 | 7/2000 |
| EP | 1260671 | | 11/2002 |
| EP | 1632640 | | 3/2006 |
| GB | 2074634 | A | 11/1981 |
| GB | 2156402 | A | 10/1985 |
| GB | 2394973 | | 5/2004 |
| GB | 2435059 | A | 8/2007 |
| GB | 2439427 | A | 12/2007 |
| WO | 0061909 | | 10/2000 |
| WO | 2005090740 | | 9/2005 |
| WO | 2007127737 | | 11/2007 |

OTHER PUBLICATIONS

International Search Report for Patent Application No. PCT/GB2010/000230, dated Apr. 6, 2010 (14 pages).
International Search Report for Patent Application No. PCT/GB2009/000349, dated Jun. 24, 2009 (15 pages).
International Search Report for Patent Application No. PCT/GB2009/000339, dated Jul. 8, 2009 (13 pages).
International Search Report for Patent Application No. PCT/GB2009/000338, dated Jul. 9, 2009 (6 pages).
International Search Report for Patent Application No. PCT/GB2009/000344, dated Jul. 9, 2009 (6 pages).
Mechanical English translation of European Patent Application No. EP1632640, published Mar. 8, 2006 (6 pages).
Unknown, "Circulating/flowback tool cuts surge pressures," Drilling Contractor, Mar./Apr. 2001, pp. 30-31 (2 pages).
International Search Report for Patent Application No. PCT/GB2009/000344, dated Oct. 6, 2009 (18 pages).
International Search Report for Patent Application No. PCT/GB2009/000338, dated Oct. 13, 2009 (19 pages).
Canadian Association of Oilwell Drilling Contractors (CAODC), "SI Drilling Manual 1st Edition", Gulf Publishing Company, Section B20, p. 1.
Office Action in U.S. Appl. No. 12/368,217; dated Nov. 24, 2010 (18 pages).
Office Action in U.S. Appl. No. 12/368,161, dated Oct. 21, 2010 (26 pages).

* cited by examiner

HYDRAULIC CONNECTOR APPARATUSES AND METHODS OF USE WITH DOWNHOLE TUBULARS

CROSS-REFERENCE TO RELATED APPLICATIONS

The present application claims benefit under 35 U.S.C. §120, as a Continuation-In-Part, to U.S. patent application Ser. No. 11/703,915, filed Feb. 8, 2007 now U.S. Pat. No. 7,690,422, which, in-turn, claims priority to United Kingdom Patent Application No. 0602565.4 filed Feb. 8, 2006. Additionally, the present application claims priority to United Kingdom Patent Application No. 0802406.9 and United Kingdom Patent Application No. 0802407.7, both filed on Feb. 8, 2008. Furthermore, the present application claims priority to United Kingdom Patent Application No. 0805299.5 filed Mar. 20, 2008. All priority applications and the co-pending U.S. parent application are hereby expressly incorporated by reference in their entirety.

BACKGROUND OF THE DISCLOSURE

1. Field of the Disclosure

The present disclosure generally relates to a connector establishing a fluid-tight connection to a downhole tubular. More particularly, the present disclosure relates to a connector establishing a fluid-tight connection between a downhole tubular and a lifting assembly. Alternatively, the present disclosure relates to a connector establishing a fluid-tight connection between a downhole tubular and another tubular.

2. Description of the Related Art

It is known in the industry to use a top-drive assembly to apply rotational torque to a series of inter-connected tubulars (commonly referred to as a drillstring comprised of drill pipe) to drill subterranean and subsea oil and gas wells. In other operations, a top-drive assembly may be used to install casing strings to already drilled wellbores. The top-drive assembly may include a motor, either hydraulic, electric, or other, to provide the torque to rotate the drillstring, which in turn rotates a drill bit at the bottom of the well.

Typically, the drillstring comprises a series of threadably-connected tubulars (drill pipes) of varying length, typically about 30 ft (9.14 m) in length. Typically, each section, or "joint" of drill pipe includes a male-type "pin" threaded connection at a first end and a corresponding female-type "box" threaded connection at the second end. As such, when making-up a connection between two joints of drill pipe, a pin connection of the upper piece of drill pipe (i.e., the new joint of drill pipe) is aligned with, threaded, and torqued within a box connection of a lower piece of drill pipe (i.e., the former joint of drill pipe). In a top-drive system, the top-drive motor may also be attached to the top joint of the drillstring via a threaded connection.

During drilling operations, a substance commonly referred to as drilling mud is pumped through the connection between the top-drive and the drillstring. The drilling mud travels through a bore of the drillstring and exits through nozzles or ports of the drill bit or other drilling tools downhole. The drilling mud performs various functions, including, but not limited to, lubricating and cooling the cutting surfaces of the drill bit. Additionally, as the drilling mud returns to the surface through the annular space formed between the outer diameter of the drillstring and the inner diameter of the borehole, the mud carries cuttings away from the bottom of the hole to the surface. Once at the surface, the drill cuttings are filtered out from the drilling mud and the drilling mud may be reused and the cuttings examined to determine geological properties of the borehole.

Additionally, the drilling mud is useful in maintaining a desired amount of head pressure upon the downhole formation. As the specific gravity of the drilling mud may be varied, an appropriate "weight" may be used to maintain balance in the subterranean formation. If the mud weight is too low, formation pressure may push back on the column of mud and result in a blow out at the surface. However, if the mud weight is too high, the excess pressure downhole may fracture the formation and cause the mud to invade the formation, resulting in damage to the formation and loss of drilling mud.

As such, there are times (e.g., to replace a drill bit) where it is necessary to remove (i.e., "trip out") the drillstring from the well and it becomes necessary to pump additional drilling mud (or increase the supply pressure) through the drillstring to displace and support the volume of the drillstring retreating from the wellbore to maintain the well's hydraulic balance. By pumping additional fluids as the drillstring is tripped out of the hole, a localized region of low pressure near or below the retreating drill bit and drill pipe (i.e., suction) may be reduced and any force required to remove the drillstring may be minimized. In a conventional arrangement, the excess supply drilling mud may be pumped through the same connection, between the top-drive and drillstring, as used when drilling.

As the drillstring is removed from the well, successive sections of the retrieved drillstring are disconnected from the remaining drillstring (and the top-drive assembly) and stored for use when the drillstring is tripped back into the wellbore. Following the removal of each joint (or series of joints) from the drillstring, a new connection must be established between the top-drive and the remaining drillstring. However, breaking and re-making these threaded connections, two for every section of drillstring removed, is very time consuming and may slow down the process of tripping out the drillstring.

Previous attempts have been made at speeding up the process of tripping-out. GB2156402A discloses methods for controlling the rate of withdrawal and the drilling mud pressure to maximize the speed of tripping-out the drillstring. However, the amount of time spent connecting and disconnecting each section of the drillstring to and from the top-drive is not addressed.

Another mechanism by which the tripping out process may be sped up is to remove several joints at a time (e.g., remove several joints together as a "stand"), as discussed in GB2156402A. By removing several joints at once in a stand (and not breaking connections between the individual joints in each stand), the total number of threaded connections that are required to be broken may be reduced by 50-67%. However, the number of joints in each stand is limited by the height of the derrick and the pipe rack of the drilling rig, and the method using stands still does not address the time spent breaking the threaded connections that must still be broken.

GB2435059A discloses a device which comprises an extending piston-rod with a bung, which may be selectively engaged within the top of the drillstring to provide a fluid tight seal between the drillstring and top-drive. This arrangement obviates the need for threading and unthreading the drillstring to the top-drive. However, a problem with the device disclosed therein is that the extension of the piston-rod is dependent upon the pressure and flow of the drilling mud through the top-drive. Whilst this may be advantageous in certain applications, a greater degree of control over the piston-rod extension independent of the drilling mud pressure is desirable.

Similarly, there may be applications where it is desirable to displace fluid from the borehole, particularly, for example, when lowering the drillstring (or a casing-string) in deepwater drilling applications. In such deepwater applications, the seabed accommodates equipment to support the construction of the well and the casing used to line the wellbore may be hung and placed from the seabed. In such a configuration, a drillstring (from the surface vessel) may be used as the mechanism to convey and land the casing string into position. As the drillstring is lowered, successive sections of drillstring would need to be added to lower the drillstring (and attached casing string) further. However, as the bore of the typical drillstring is much smaller than the bore of a typical string of casing, fluid displaced by the casing string will flow up and exit through the smaller-bore drillstring, at increased pressure and flow rates. As such, designs such as those disclosed in GB2435059A would not allow reverse flow of drilling mud (or seawater) as would be required in such a casing installation operation.

Embodiments of the present disclosure seek to address these and other issues of the prior art.

SUMMARY OF THE CLAIMED SUBJECT MATTER

In one aspect, the present disclosure relates to a hydraulic connector to provide a fluid tight connection between a fluid supply and a downhole tubular including an engagement assembly configured to extend and retract a seal assembly disposed at a distal end of the hydraulic connector into and from a proximal end of the downhole tubular, and a valve assembly operable between an open position and a closed position, wherein the valve assembly is configured to allow the fluids to communicate between the fluid supply and the downhole tubular through the seal assembly when in the open position, and wherein the valve assembly is configured to prevent fluid communication between the fluid supply and the downhole tubular when closed position.

In another aspect, embodiments of the present disclosure relate to a hydraulic connector to provide a fluid tight connection between a fluid supply and a downhole tubular including a body portion, an extendable portion recriprocable with respect to the body portion, and a seal assembly at a distal end of the extendable portion, wherein the seal assembly is configured to sealingly engage the downhole tubular, and wherein the seal assembly is detachable from the extendable portion.

In another aspect, embodiments of the present disclosure relate to a method to provide a fluid tight connection between a fluid supply and a downhole tubular using a hydraulic connector including disposing a seal assembly upon a distal end of a piston-rod assembly, increasing a pressure of fluids in the fluid supply, extending the piston-rod assembly, and engaging the seal assembly within a proximal end of the downhole tubular, engaging at least one of the seal assembly and a threaded member within a proximal end of the downhole tubular.

BRIEF DESCRIPTION OF DRAWINGS

Features of the present disclosure will become more apparent from the following description in conjunction with the accompanying drawings.

DETAILED DESCRIPTION

Select embodiments describe a tool to direct fluids from a top-drive (or other lifting) assembly and a bore of a downhole tubular. In particular, the tool may include an engagement assembly to extend a seal assembly into the bore of the downhole tubular, a valve assembly to selectively allow pressurized fluids from the top-drive assembly to enter the downhole tubular, and a reverse flow valve assembly to selectively allow pressurized fluids from the downhole tubular to flow toward the top-drive assembly within the tool.

Figure 1A:
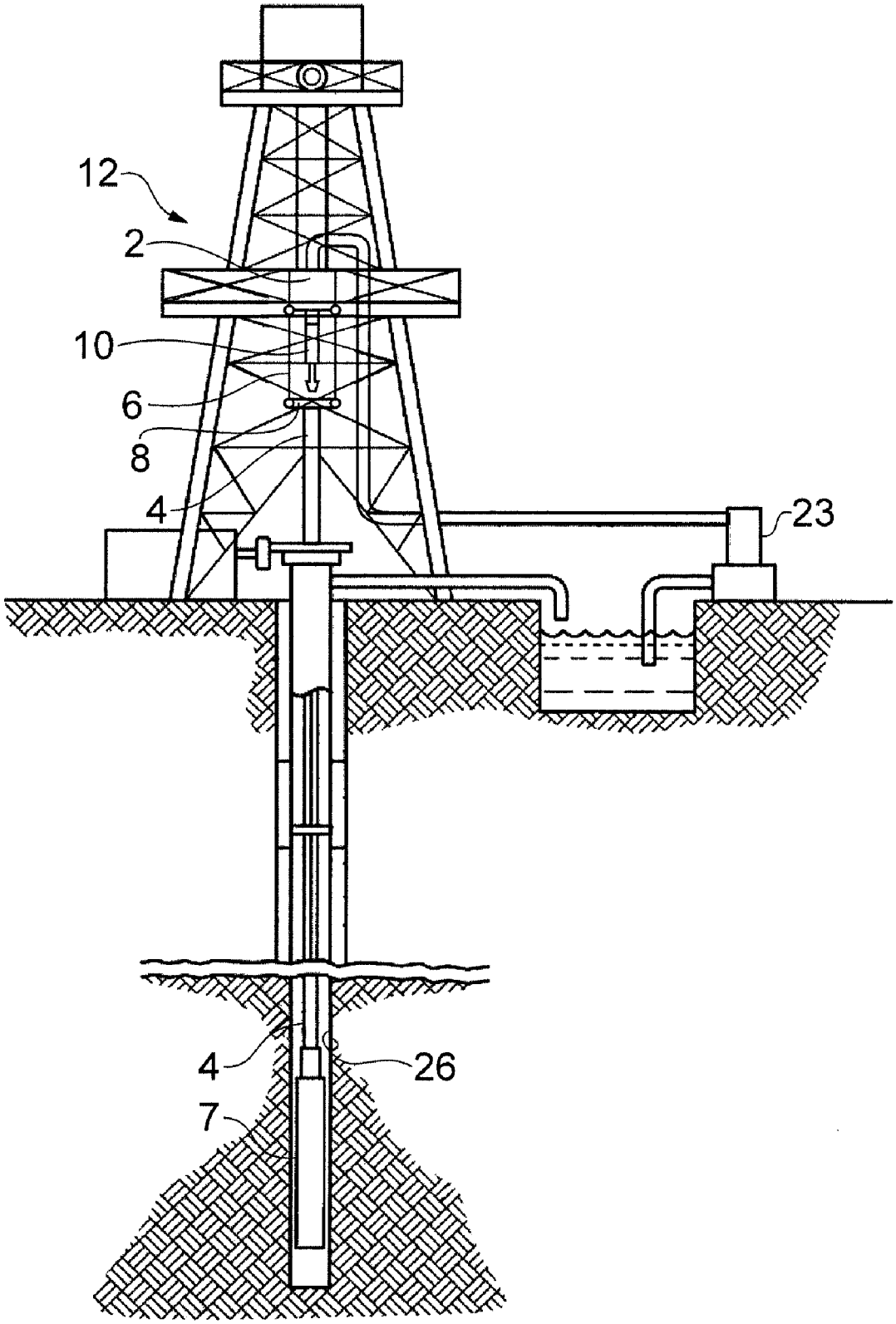
FIGS. 1*a* and 1*b* schematically depict a connector in accordance with embodiments of the present disclosure and depicts the connector in position between a top-drive and a downhole tubular.
Figure 1B:
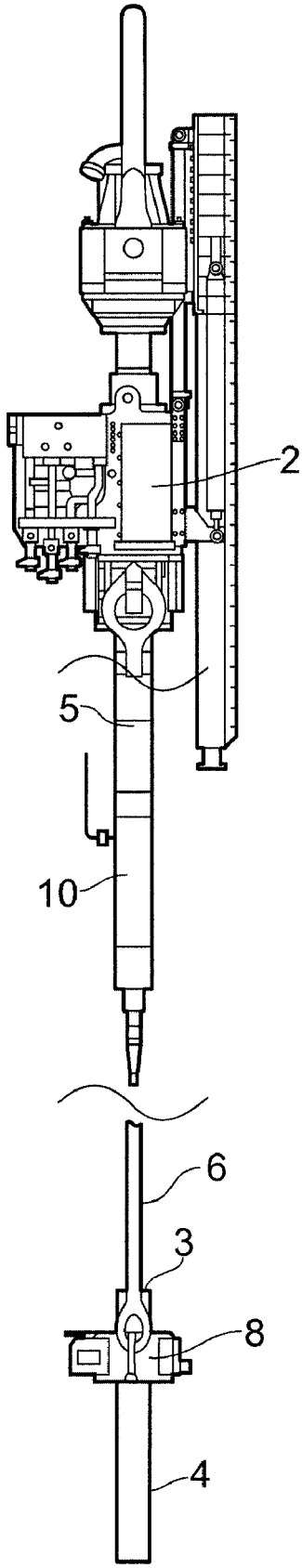

Referring initially to FIGS. 1*a* and 1*b* (collectively referred to as "FIG. 1"), a top-drive assembly 2 is shown connected to a proximal end of a string of downhole tubulars 4. As shown, top-drive 2 may be capable of raising ("tripping out") or lowering ("tripping in") downhole tubulars 4 through a pair of lifting bales 6, each connected between lifting ears of top-drive 2, and lifting ears of a set of elevators 8. When closed (as shown), elevators 8 grip downhole tubulars 4 and prevent the string from sliding further into a wellbore 26 (below).

Thus, the movement of string of downhole tubulars 4 relative to the wellbore 26 may be restricted to the upward or downward movement of top-drive 2. While top-drive 2 (as shown) must supply any upward force to lift downhole tubular 4, downward force is sufficiently supplied by the accumulated weight of the entire free-hanging string of downhole tubulars 4, offset by their accumulated buoyancy forces of the downhole tubulars 4 in the fluids contained within the wellbore 26. Thus, as shown, the top-drive assembly 2, lifting bales 6, and elevators 8 must be capable of lifting (and holding) the entire free weight of the string of downhole tubulars 4.

As shown, string of downhole tubulars 4 may be constructed as a string of threadably connected drill pipes (e.g., a drillstring 4), may be a string of threadably connected casing segments (e.g., a casing string 7), or any other length of generally tubular (or cylindrical) members to be suspended from a rig derrick 12. In a conventional drillstring or casing string, the uppermost section (i.e., the "top" joint) of the string of downhole tubulars 4 may include a female-threaded "box" connection 3. In some applications, the uppermost box connection 3 is configured to engage a corresponding male-threaded ("pin") connector 5 at a distal end of the top-drive assembly 2 so that drilling-mud or any other fluid (e.g., cement, fracturing fluid, water, etc.) may be pumped through top-drive 2 to bore of downhole tubulars 4. As the downhole tubular 4 is lowered into a well, the uppermost section of downhole tubular 4 must be disconnected from top-drive 2 before a next joint of string of downhole tubulars 4 may be threadably added.

As would be understood by those having ordinary skill, the process by which threaded connections between top-drive 2 and downhole tubular 4 are broken and/or made-up may be time consuming, especially in the context of lowering an entire string (i.e., several hundred joints) of downhole tubulars 4, section-by-section, to a location below the seabed in a deepwater drilling operation. The present disclosure therefore relates to alternative apparatus and methods to establish the connection between the top-drive assembly 2 and the string of downhole tubulars 4 being engaged or withdrawn to and from the wellbore. Embodiments disclosed herein enable the fluid connection between the top-drive 2 (in communication with a mud pump 23 and the string of downhole tubulars 4 to be made using a hydraulic connector tool 10 located between top-drive assembly 2 and the top joint of string of downhole tubulars 4.

However, it should be understood that while a top-drive assembly 2 is shown in conjunction with hydraulic connector 10, in certain embodiments, other types of "lifting assemblies" may be used with hydraulic connector 10 instead. For example, when "running" casing or drill pipe (i.e., downhole tubulars 4) on drilling rigs (e.g., 12) not equipped with a top-drive assembly 2, hydraulic connector 10, elevator 8, and lifting bales 6 may be connected directly to a hook or other lifting mechanism to raise and/or lower the string of downhole tubulars 4 while hydraulically connected to a pressurized fluid source (e.g., a mud pump, a rotating swivel, an IBOP, a TIW valve, an upper length of tubular, etc.). Further still, while some drilling rigs may be equipped with a top-drive assembly 2, the lifting capacity of the lifting ears (or other components) of the top-drive 2 may be insufficient to lift the entire length of string of downhole tubular 4. In particular, for extremely long or heavy-walled tubulars 4, the hook and lifting block of the drilling rig may offer significantly more lifting capacity than the top-drive assembly 4.

Therefore, throughout the present disclosure, where connections between hydraulic connector 10 and top-drive assembly 2 are described, various alternative connections between the hydraulic connector and other, non-top-drive lifting (and fluid communication) components are contemplated as well. Similarly, throughout the present disclosure, where fluid connections between hydraulic connector 10 and top-drive assembly 2 are described, various fluid and/or lifting arrangements are contemplated as well. In particular, while fluids may not physically flow through a particular lifting assembly lifting hydraulic connector 10 and into tubular, fluids may flow through a conduit (e.g., hose, flex-line, pipe, etc) used alongside and in conjunction with the lifting assembly and into hydraulic connector 10.

Figure 2:
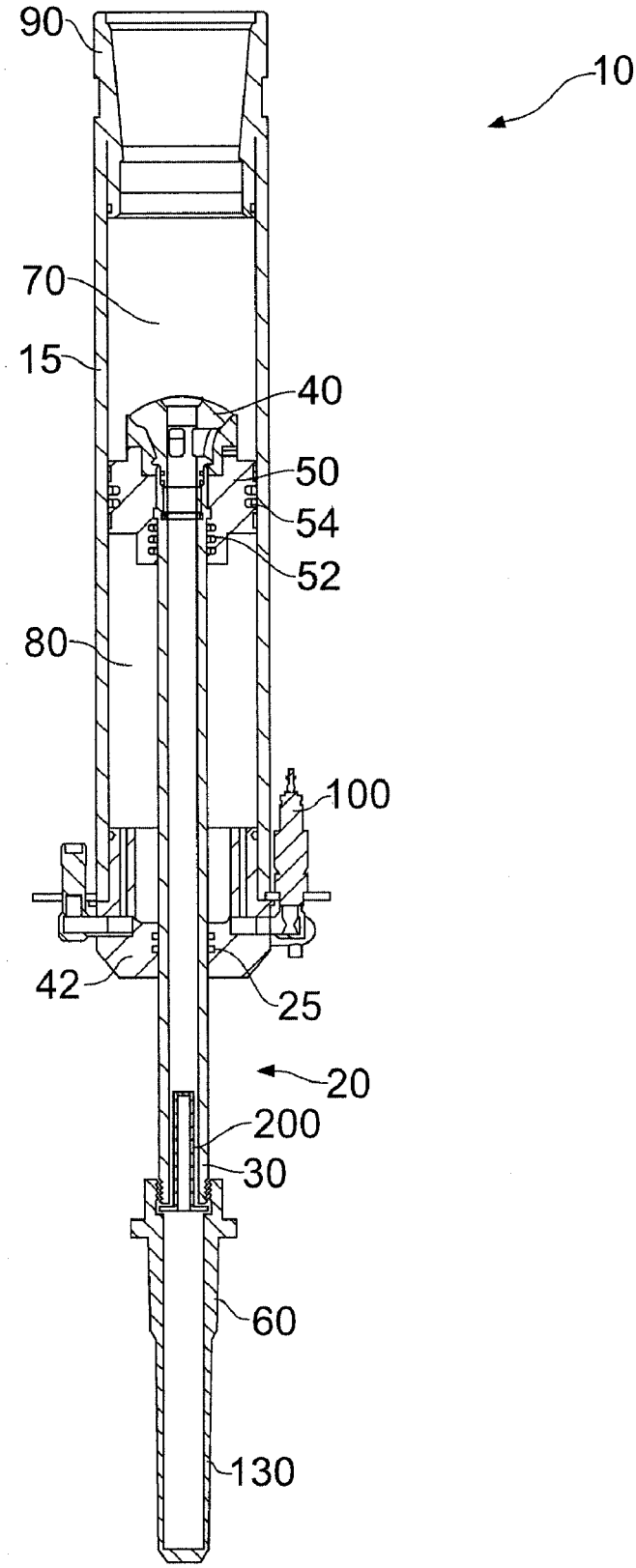
FIG. 2 is a sectional side projection of a connector in accordance with embodiments disclosed herein showing the connector prior to engagement with the string of downhole tubulars.

With reference to FIG. 2, a hydraulic connector 10, according to a first embodiment of the disclosure, comprises a cylinder 15 and a piston-rod assembly 20, the piston-rod assembly 20 being slidably engaged in the cylinder 15. The piston-rod assembly 20 may further comprise a hollow tubular rod 30, on which is mounted a cap 40, the tubular rod 30 being slidably engaged in the cylinder 15 such that a first end (i.e., a lower end) of the tubular rod 30 protrudes outside the cylinder 15 and a second end (i.e., an upper end) is within the cylinder 15. The cap 40 is shown mounted on the second, upper, end of the tubular rod 30, whilst on a first end of the tubular rod 30 there is located a bung 60 with seals (e.g. cup seals) 130. The bung 60 may be made from an appropriate sealing material, including, but not limited to, nylon, rubber, or any other appropriate polymer or elastomer, and may be shaped to fit into the top end (typically a box end) of the string of downhole tubulars 4.

A tubular filter 200 may be disposed between the first end of the tubular rod 30 and the bung 60. The filter 200 may be substantially cylindrical with a closed end and an open end between its side-walls. The open end of the filter 200 may comprise an outer-flanged portion about its circumference, which may abut the first end of the tubular rod 30. As shown, the bung 60 threadably engages an outer portion of the first end of the tubular rod 30 and an abutment shoulder within bung 60 abuts the flanged portion of the filter 200 to secure it between the tubular rod 30 and bung 60. In this manner the bung 60 and filter 200 may easily be disconnected from the lower end of tubular rod 30 for replacement, inspection, and/or cleaning.

As shown, filter 200 is arranged with its open end facing (downward) toward bung 60 and the closed end (upward) facing cap 40. Thus, filter 200 may be contained primarily within tubular rod 30 so that flow from the string of downhole tubulars 4 to the hydraulic connector 10 flows will first enter the open end of filter 200, then encounter the side-walls, and finally the closed end of the filter 200. The filter 200 may be sized so that a sufficient gap is provided between the side-walls of the filter and the tubular rod 30, whilst maintaining a sufficient internal diameter of the filter. The dimensions of the filter 200 (e.g., diameter, length, etc.) relative to the tubular rod 30 may be selected so as to reduce the pressure drop across the filter. In certain embodiments, filter 200 may comprise a perforated pipe having a perforated closed end. In alternative embodiments filter 200 may comprise a wire mesh. In still further alternative embodiments, filter 200 may comprise a non-perforated closed end, or any other conventional filter arrangement known to those having ordinary skill.

The tubular rod 30, cylinder 15, bung 60 and cap 40 shown in FIG. 2 are arranged such that their longitudinal axes are coincident. At the lower end of the cylinder 15, beyond which the tubular rod 30 protrudes, there is mounted an end-cap 42. The end-cap 42 seals the inside of the cylinder 15 from the outside, whilst also allowing the tubular rod 30 to slide (i.e., reciprocate) in or out of the cylinder 15. Seals 25 (e.g., o-rings) may be used to seal between the end-cap 42 and tubular rod 30.

As shown in FIG. 2, hydraulic connector 10 further includes a piston 50 slidably mounted on tubular rod 30 inside cylinder 15. As shown, piston 50 is free to reciprocate between the cap 40 and the end-cap 42. Additionally, in certain embodiments, piston 50 may also be capable of rotating about its center axis with respect to cylinder 15. Furthermore, the entire assembly (20, 40, 50 and 60) may be able to slide (and/or rotate) with respect to cylinder 15. As such, the inside of the cylinder 15 may be divided by the piston 50 into a first (lower) chamber 80 and a second (upper) chamber 70. When viewed in a downward direction from above (e.g., from the top-drive), the projected area of the piston 50 may be less than the projected area of the cap 40 such that when the piston 50 abuts the cap 40, the pressure force from the fluid in the second chamber 70 acting on the cap 40 is greater than that acting on the piston 50.

In certain embodiments, the first and second chambers 80 and 70 may be energized with air and drilling mud respectively. Alternatively, any appropriate actuation fluid, including, but not limited to, air, nitrogen, water, drilling mud, and hydraulic fluid, may be used to energize lower chamber 80.

The piston 50 may be sealed against the tubular rod 30 and cylinder 15, for example, by means of o-ring seals 52 and 54, to prevent fluid communication between the two chambers 70 and 80. First chamber 80 may be in fluid communication with an air supply via a port 100, which may selectively pressurize first chamber 80. Second chamber 70 may be provided with drilling mud from the top-drive 2 via a socket 90, which may (as shown) be a box component of a rotary box-pin threaded connection. Top-drive 2 may be connected to the hydraulic connector 10 via the engagement of a cooperating (e.g., a pin component of a rotary box-pin) threaded connection (not shown).

Figure 3:
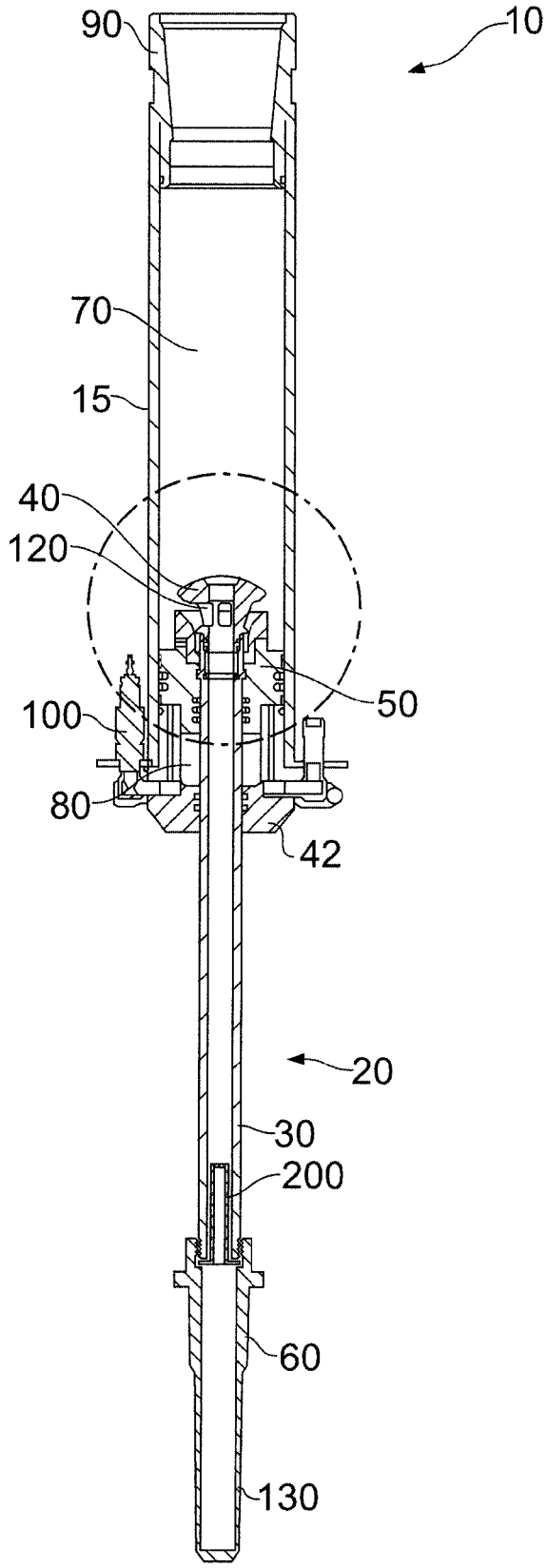
FIG. 3 is a sectional side projection of the connector of FIG. 2 in an engaged position.

As shown in FIG. 2, the piston 50 and cap 40 are touching, so that drilling mud cannot flow from the second chamber 70 to the string of downhole tubulars 4. FIG. 3 shows an alternative position of the cap 40 with respect to piston 50. As shown in FIG. 3, with the cap 40 and piston 50 apart, holes 120 are exposed in the side of the cap 40. These holes 120 provide a fluid communication path between the second chamber 70 and the interior of the tubular rod 30. Thus drilling mud may flow from the second chamber 70 to the string of downhole tubulars 4, via the holes 120 in the cap 40 and the tubular rod 30 when cap 40 is displaced above piston 50.

Figure 4A:
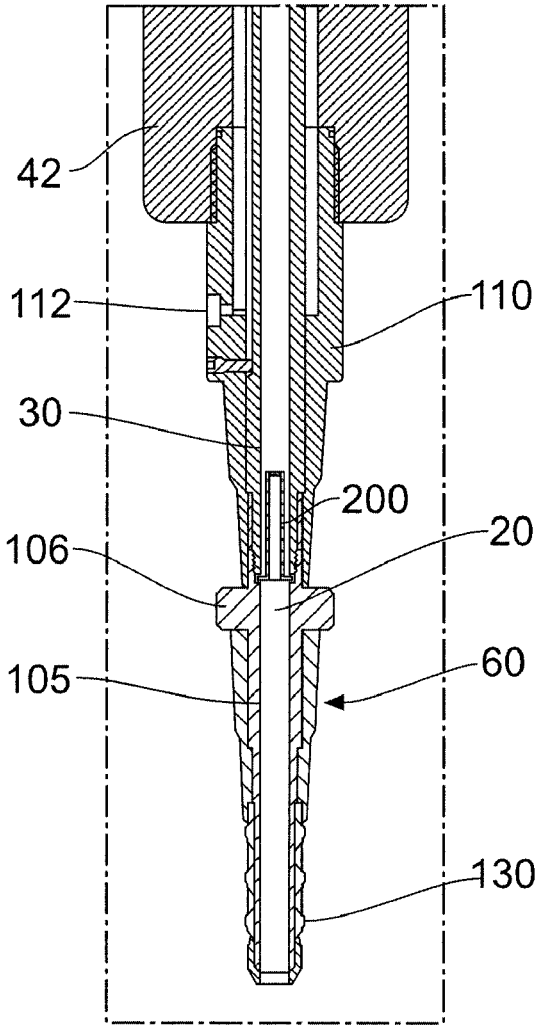
FIGS. 4*a* and 4*b* are more detailed sectional views of a sealing assembly of the connector according to embodiments of the present disclosure.

With reference to FIG. 4*a*, the bung 60, may comprise a detachable shaft 105. Detachable shaft 105 may be threadably attached to tubular rod 30 and may therefore be selectively detachable from tubular rod 30. Additionally, seals 130 may be provided around an outer profile of detachable shaft 105. Detachable shaft 105 may be hollow to accommodate fluids flowing from top-drive assembly 2, through shaft 16, through tubular rod 30, and into downhole tubular 4.

In certain embodiments, detachable shaft 105 and attached seals 130 may be interchangeable with alternative shaft and seal configurations. In select embodiments, interchangeable configurations may facilitate repair and replacement of worn seals 130. Further, interchangeable configurations may allow for bungs 60 of different shapes and configurations to be deployed for different configurations of downhole tubulars (e.g., 4 of FIG. 1). Furthermore, in certain embodiments, a connection between tubular rod 30 and detachable shaft 105 may be constructed to act as a sacrificial connection. In such embodiments, if an impact load is applied to bung 60, the connection may fail, so that piston-rod assembly 20, cylinder 15, and remainder of hydraulic connector 10 may be protected from damage. For example, detachable shaft 105 may be provided with a female-threaded socket configured to engage a corresponding male thread of tubular rod 30. As such, the female thread of detachable shaft 105 may be deliberately weakened, for example, at its root, so that it may fail before damage occurs to tubular rod 30. Filter 200 may be located between an abutment shoulder in the female threaded socket of the detachable shaft 105 and the male thread on the tubular rod 30.

In select embodiments, the end of the detachable shaft 105 attached to tubular rod 30, may have similar (or smaller) external dimensions as tubular rod 30 to ensure that detachable shaft 105 may fit inside a threaded member 110 that (in certain embodiments) may optionally be threaded to the end of end-cap 42. Threaded member 110 may be connected to the first end cap 42 by virtue of a threaded connection and the threaded member 110 is hollow to allow the tubular rod 30 to pass through it. The threaded member 110 may seal the inside of cylinder 15 from the outside, whilst also allowing the tubular rod 30 to slide in or out of the cylinder 15. In another alternative embodiment, the threaded member 110 and end-cap 42 may be integral and comprise a single component.

The end of the detachable shaft 105, which attaches to the tubular rod 30, has the same or smaller external dimensions as the tubular rod 30. This ensures that the detachable shaft 105 fits inside the threaded member 110. Furthermore, the detachable shaft 105 has a protrusion 106, which acts as a mechanical stop limiting the retraction of the piston-rod assembly 20 into the cylinder 15. The protrusion 106 is shaped with spanner flats so that the detachable shaft 105 can be removed from the tubular rod 30.

Figure 4B:
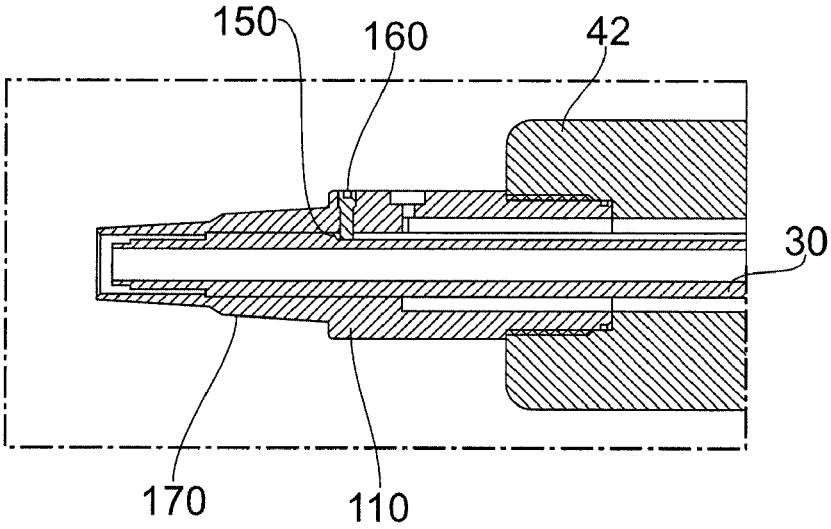

Referring now to FIG. 4*b*, tubular rod 30 is shown further including an abutment shoulder 150. In certain embodiments, abutment shoulder 150 may be formed as a flat portion on the outer surface of tubular rod 30 adjacent to a cylindrical portion. Abutment shoulder 150 may provide a keyway configured to receive a corresponding key 160 of threaded member 110. Key 160 may engage the keyway of abutment shoulder 150 so that rotation of the tubular rod 30 relative to threaded member 110 is prevented, thereby facilitating removal of detachable shaft 105. Furthermore, tubular rod 30 may be fully retracted within threaded member 110 when detachable shaft 105 is removed, such that tubular rod 30 does not extend beyond the end of threaded member 110. Key 160 and keyway may also mechanically limit the retraction of the piston-rod assembly 20 when detachable shaft 105 is removed.

Additionally, threaded member 110 may optionally include a threaded section 170. In select embodiments, threaded section 170 may threadably connect to an open end of downhole tubular 4 so that hydraulic connector 10 may transmit torque from top-drive assembly 2 to downhole tubular 4. Accordingly, in order to transmit torque, threaded connections between top-drive assembly 2, threaded connection 25, threaded member 110, and downhole tubular 4 should be selected that the make-up and break-out directions are the same.

One or more intermediate portions may be fitted to the threaded section 170 so that the threaded member 110 (and hence connector 10) may be connected to a variety of tubulars having different diameters. For example, an intermediate portion in the form of a swage may be connected to both (a) the threaded section 170 of the threaded member by virtue of an internal thread in the swage (i.e. a box connection) and (b) the internal thread of a casing string section by virtue of an external thread on the swage body (i.e. pin connection). Thus, by providing a plurality of intermediate portions with a range of external dimensions, the connector 10 may be connected to a corresponding range of downhole tubulars.

Detachable shaft 105 (and therefore bung 60) may be removed from the tubular rod 30 when threaded member 110 is connected (directly) to downhole tubular 4. Tubular rod 30 may be sized so that it fits inside the interior of downhole tubular 4 beyond a threaded portion of an open end of downhole tubular 4. Alternatively, tubular rod 30 may be retracted into threaded member 110.

In an alternative embodiment, detachable shaft 105 need not be removed from tubular rod 30 when threaded member 110 is attached directly to downhole tubular 4. Hydraulic connector 10 may be connected to downhole tubular 4 by both bung 60 and threaded member 110. As such, the alternative embodiment may allow rapid connection of hydraulic connector 10 between a downhole tubular 4 and a top-drive assembly 2 without having to remove the detachable shaft 105, thereby saving time and money. To engage threaded member 110 with downhole tubular 4 without removing detachable shaft 105, protrusion 106 may be constructed smaller than shown in FIG. 3*a* so that it does not radially extend beyond the outer surface of bung 60.

Additionally, threaded member 110 may be removable from first end cap 42 and may therefore be interchangeable with alternative threaded members. This interchangeability may facilitate repair of the threaded member 110 and may also enable differently-shaped threaded members (110) to be configured for use with a particular downhole tubular 4.

Figure 5:
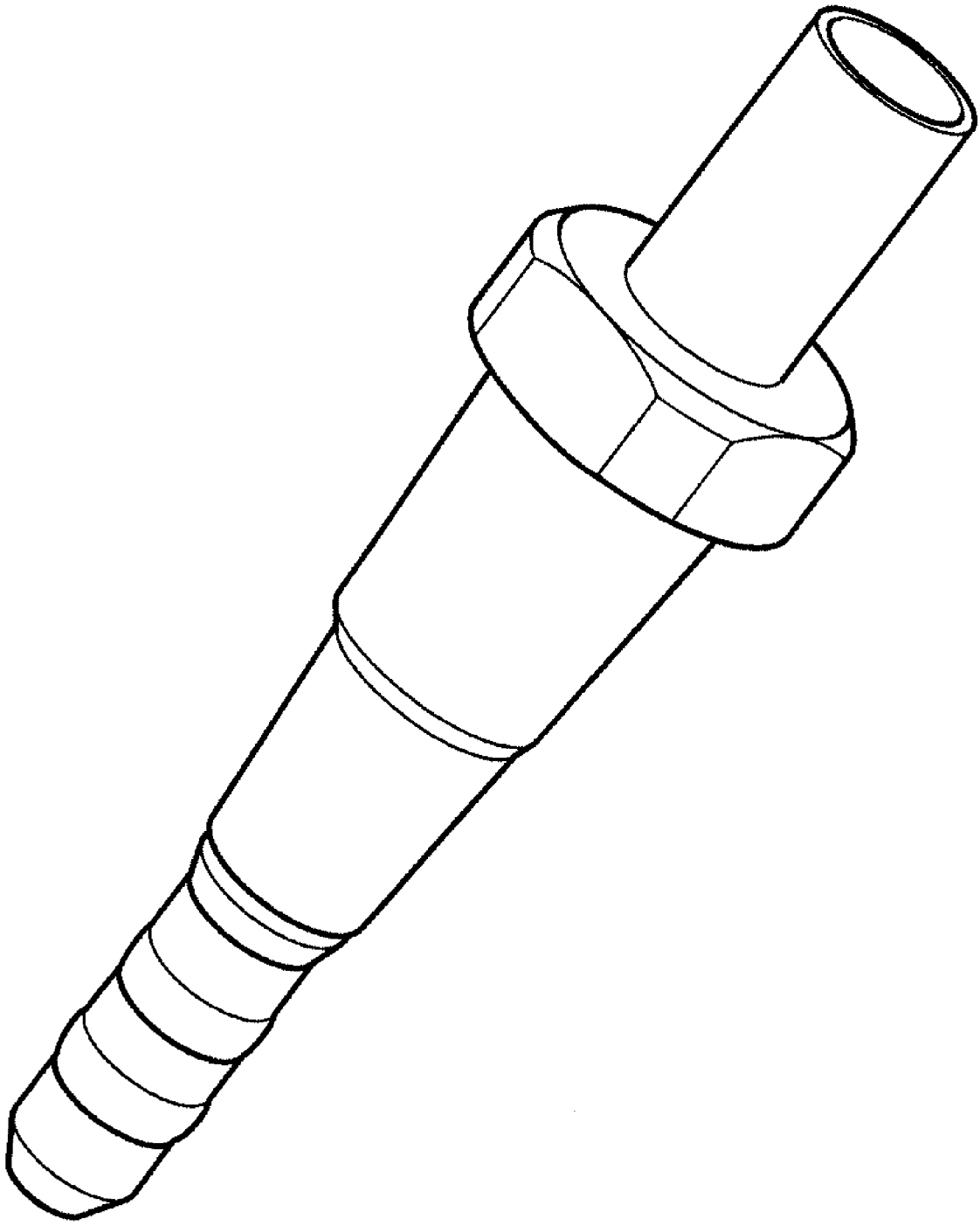
FIG. 5 is a profiled representation of a sealing arrangement in accordance with embodiments disclosed herein.
Figure 6:
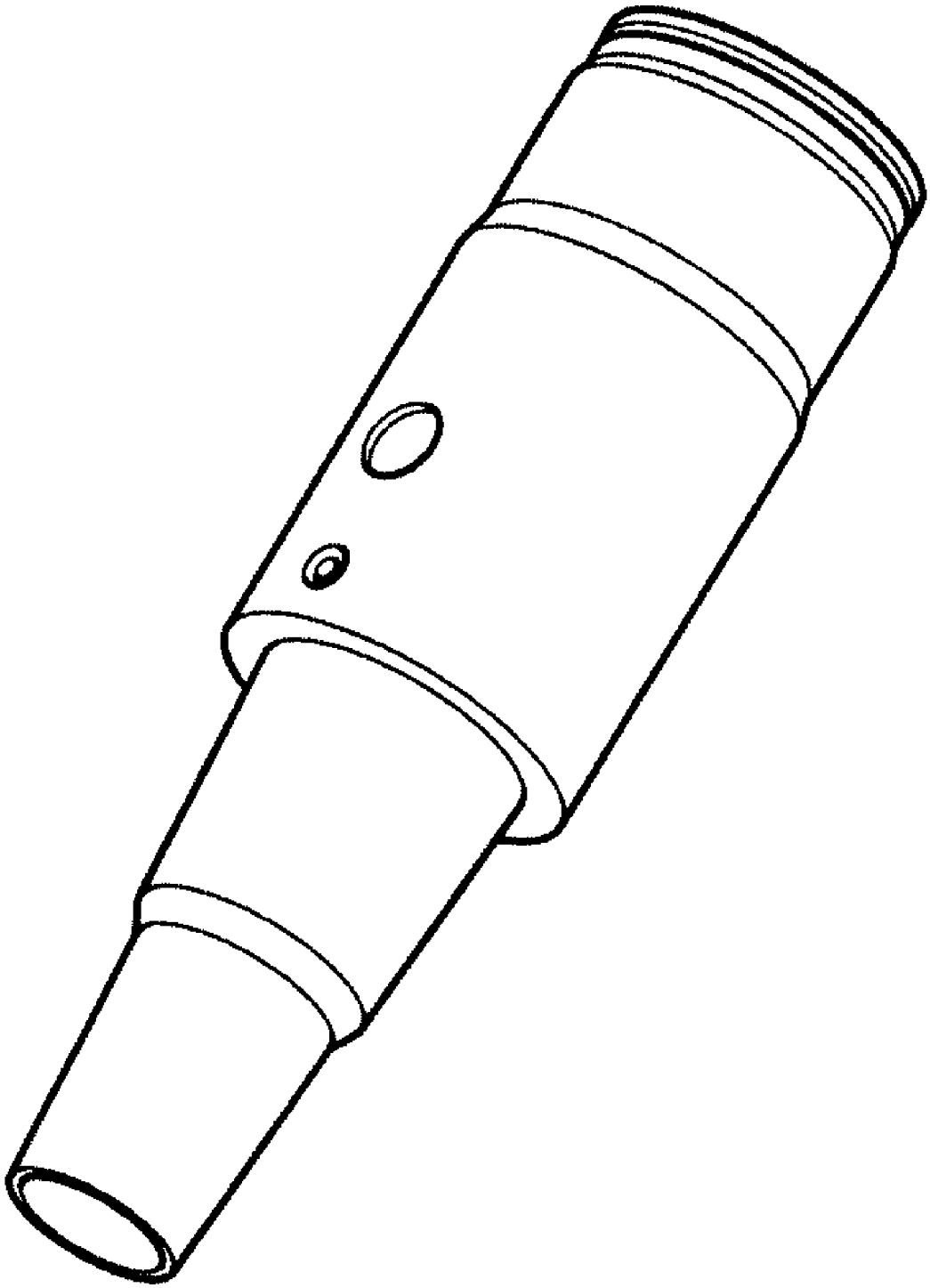
FIG. 6 is a profiled representation of a threaded member in accordance with embodiments disclosed herein.

FIGS. 5 and 6 are representations of the bung 60 and the threaded member 110 respectively showing the features mentioned above in perspective view.

Figure 7A:
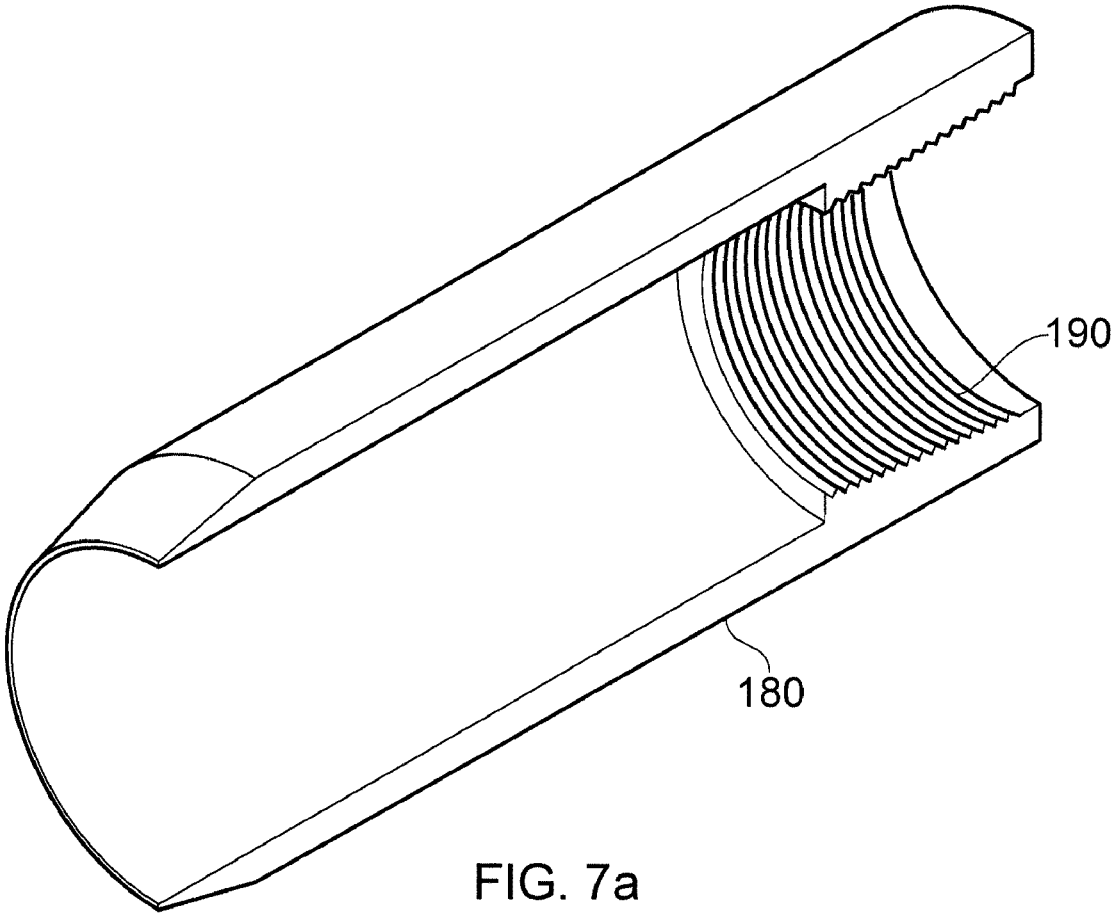
FIGS. 7*a* and 7*b* show perspective sectional views of a protector cap usable with a hydraulic connector in accordance with embodiments disclosed herein.
Figure 7B:
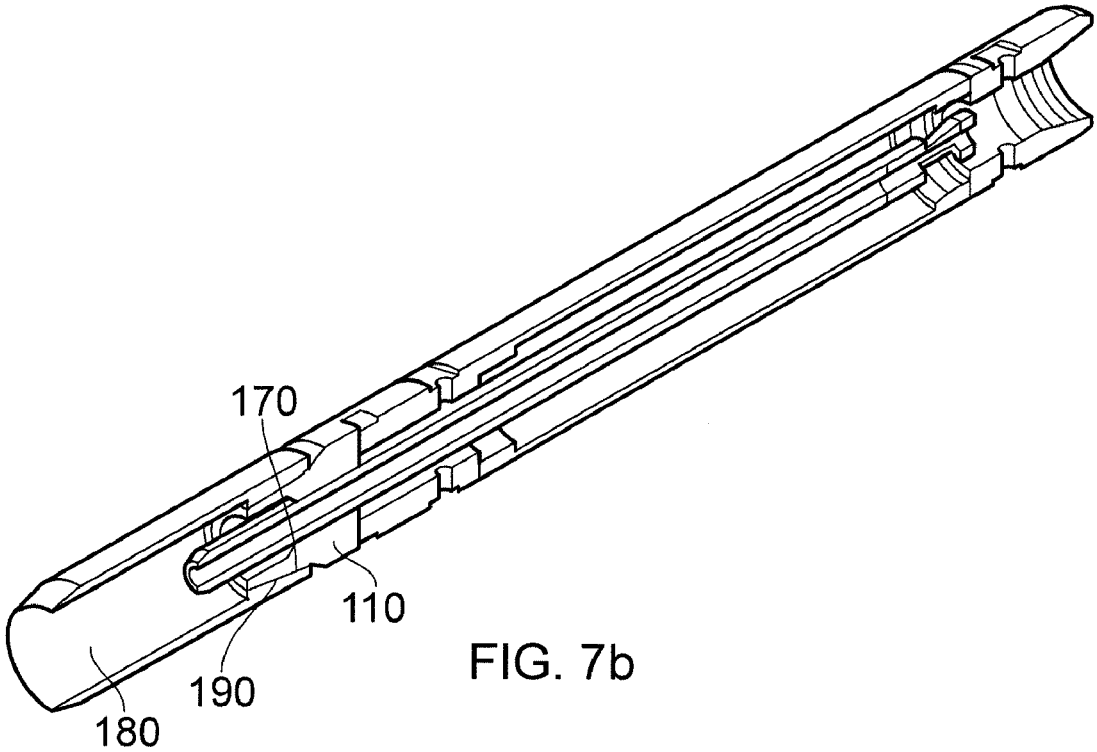

Additionally, referring to FIGS. 7*a* and 7*b*, threaded section 170 of threaded member 110 may include a "protector" cap 180 may be provided to protect threads 170 when not in use. Such a protector cap 180 may be constructed of any metallic material known those having ordinary skill in oilfield connections, but may, in the alternative, be constructed from plastic or elastomeric materials (e.g., urethane, nylon, PTFE, polyethylene, etc.). Additionally, protector cap 180 may be constructed as a generally tubular member having internal threads 190 corresponding to threads 170 at a proximal end and an open end (through which components of piston-rod assembly 20, bung 60, or tubular rod 30 may pass) at a distal end. Optionally, the protector cap may include an elongated tubular portion between the distal and proximal ends to server as a protector for components of piston-rod assembly 20 that may be retracted or otherwise housed within the threaded protector cap 180.

Figure 8A:
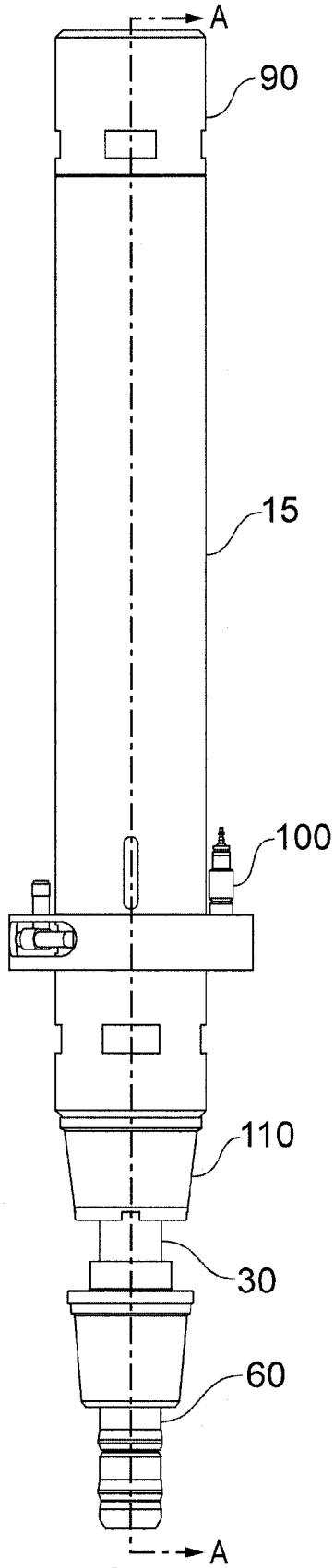
FIG. 8*a* is a side view of a connector in accordance with embodiments disclosed herein and FIG. 8*b* is a sectional side view of section A-A shown in FIG. 6*a*.
Figure 8B:
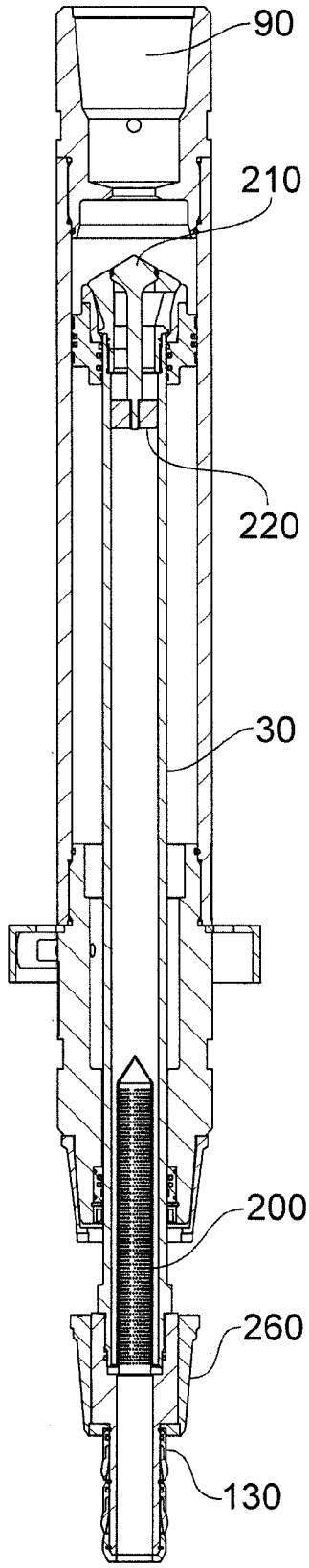

With reference to FIGS. 8*a* and 8*b*, a hydraulic connector 10, according to an alternative embodiment of the disclosure, is shown comprising a poppet valve 210. The poppet valve 210 is a one-way flow valve and may be used in place of the valve shown in FIGS. 2 and 3. The hydraulic connector 10, according to this alternative embodiment may also comprise an additional cup seal 260 on bung 60 to facilitates improved engagement with the top end of the string of downhole tubulars 4. However, those having ordinary skill in the art will appreciate that cup seals should not be limited to the embodiment shown in FIGS. 8*a* and 8*b*, in that cup seals may be applicable to the embodiments shown in FIGS. 2-5 as well.

Additionally, filter 200 of this alternative embodiment may also comprise a conical section at the closed end of the filter 200 facing the cap 40. The conical section on the filter 200 may assist in directing the flow from the hydraulic connector 10 to the string of downhole tubulars 4 and may also improve the ability of the filter 200 to self-clean.

Figure 9A:
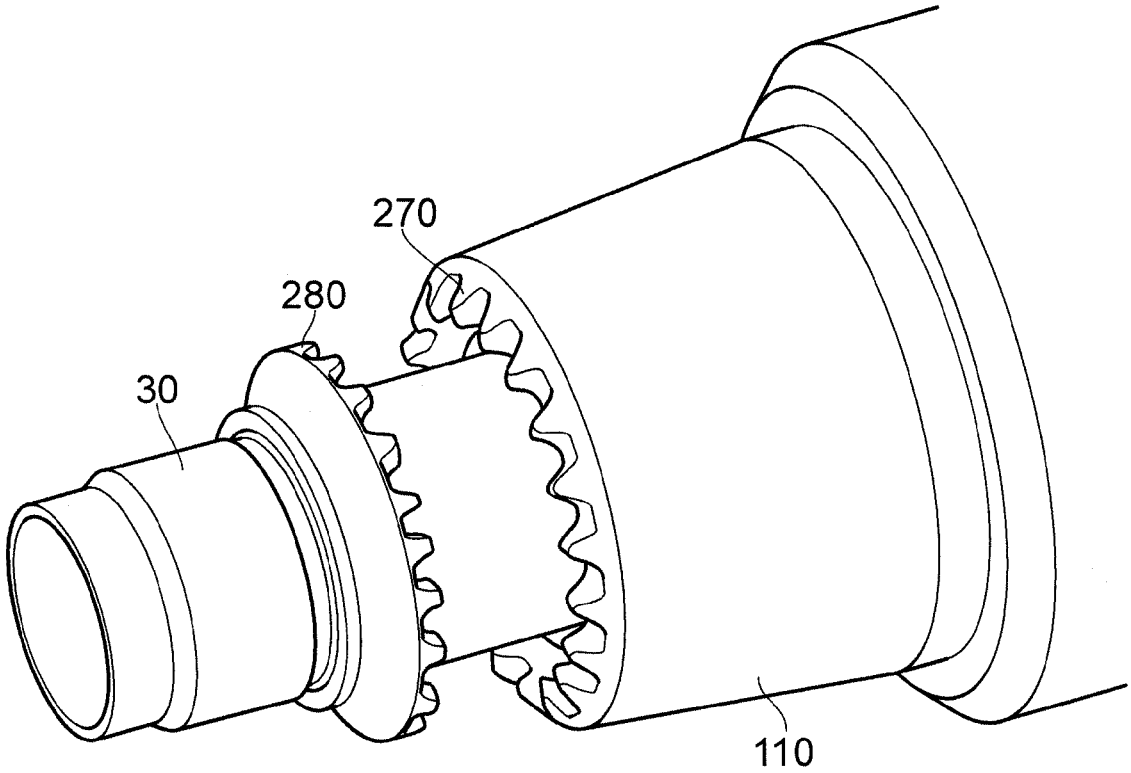
FIGS. 9*a* and 9*b* show perspective views of a locking feature for hydraulic connectors in accordance with embodiments disclosed herein.
Figure 9B:
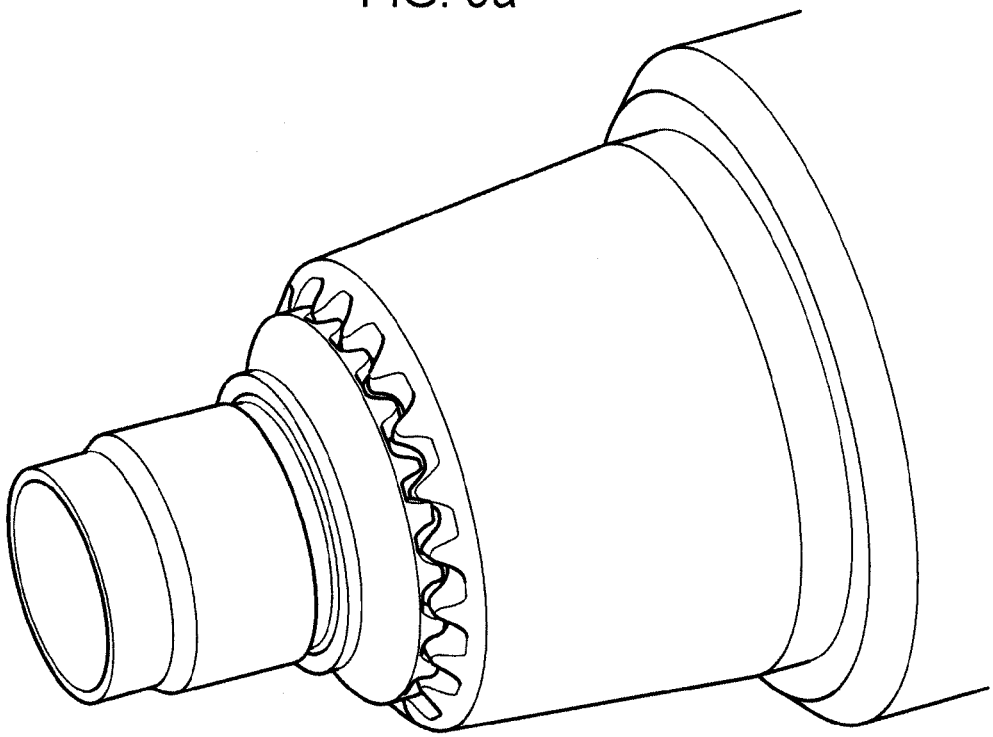

With reference to FIGS. 9*a* and 9*b*, the threaded member 110 in accordance with embodiments disclosed herein may include one or more teeth 270 and the tubular rod 30 (or tubular-rod assembly 20) may one or more corresponding teeth 280. Teeth 270 of threaded member 110 may be provided on an end face of the threaded member 110 and teeth 280 may be provided on a ring disposed about tubular rod 30. Teeth 270 of threaded member 110 and teeth 280 of tubular rod 30 may be arranged so that when tubular rod 30 is in a retracted position (FIG. 9*b*), teeth 270 interlock with teeth 280 and relative rotation between the body portion of hydraulic connector 10 and tubular rod 30 is prevented. In contrast, when the tubular rod 30 is in an extended position (FIG. 9*a*), teeth 270 and 280 are disengaged and tubular rod 30 is free to rotate relative to the body portion (i.e., threaded member 110) of hydraulic connector 10. Alternatively, teeth 270 may be provided on the body portion of hydraulic connector 10 rather than upon threaded member 110. Additionally, teeth 270 and 280 may be constructed as splines and corresponding recesses.

Operation of the hydraulic connector 10 according to the embodiments disclosed herein will now be described. To extend the piston rod 30, so that the bung 60 and seal 130 engage the string of downhole tubulars 4, the pressure of the drilling mud in the second chamber 70 of the connector may be increased by allowing flow from the top-drive 2. The air in the first chamber 80 may be set at a pressure sufficiently high to ensure that the piston 50 abuts the cap 40. As the pressure of the drilling mud increases, the force exerted by the drilling mud on the piston 50 and cap 40 exceeds the force exerted by the air in the first chamber on the piston 50 and the air outside the hydraulic connector 10 acting on the piston-rod assembly 20. The cap 40 is then forced toward the end-cap 42 and the piston-rod assembly 20 extends. As the projected area of the cap 40 is greater than the projected area of the piston 50 and the air pressure in the first chamber 80 is only exposed to the piston 50, the piston 50 may remain abutted against cap 40. Thus, whilst the piston-rod assembly 20 is extending, the holes 120 are not exposed and drilling mud cannot flow from the top-drive 2 into the string of downhole tubulars 4.

Once the bung 60 and seals 130 are forced into the open threaded end of the upper end of the string of downhole tubulars 4, thereby forming a fluid tight seal between the piston-rod assembly 20 and the open end of the drill string 4, the piston-rod assembly 20, and hence cap 40, are no longer able to extend. In contrast, as the piston 50 is free to move on the tubular rod 30, the piston 50 is forced further along by the pressure of the drilling mud in the second chamber 70. The holes 120 are thus exposed and drilling mud is allowed to flow from the second chamber 70, through the piston-rod assembly 20 and into the string of downhole tubulars 4. With the holes 120 open, the hydraulic connector 10 will ensure that the volume displaced by the removal of the string of downhole tubulars 4 from the well is replaced by drilling mud. The pressure of the air in the first chamber 80 may then be released until retraction of the piston-rod assembly 20 is required.

If the piston-rod assembly 20 extends fully from cylinder 15 before bung 60 and seals 130 fully engage string of downhole tubulars 4, the piston 50 will be prevented from lowering further by the end-cap 42. The holes 120 will therefore be unable to open and this ensures that no drilling mud is spilt if the piston-rod assembly 20 does not fully engage a string of downhole tubulars 4.

Finally, when it is desired to retract the piston-rod assembly 20 from the string of downhole tubulars 4, the pressure of the air in the first chamber 80 may be increased. The top-drive's drilling mud pumps may also be stopped to reduce the pressure of the drilling mud in the second chamber 70. The force exerted on the piston 50 by the drilling mud may then be less than the force exerted on the piston 50 by the air so that the piston 50 is biased towards the cap 40 and socket 90. The upward movement of piston 50 retracts the piston-rod assembly 20 into the cylinder 15 and out of string of downhole tubulars 4. Additionally, the upward movement of piston 50 results in abutment of the cap 40 therewith, thereby closing the holes 120 and preventing mud from flowing out of the hydraulic connector 10. With the piston-rod assembly 20 is retracted, the bung 60 and the seals 130 are retracted from the string of downhole tubulars 4 and the top most section of the string of downhole tubulars 4 may be removed.

During back-flow, when drilling fluid flows from the string of downhole tubulars 4 to the top-drive 2, the filter 200 may filter out any debris and particulate matter, thereby protecting various components of the hydraulic connector 10 and the top-drive 2. The (upward) orientation of the filter 200 encourages any debris to collect at the closed (i.e., uppermost) end of the filter. Thus, when the flow is reversed such that drilling fluid flows from the top-drive 2 to the string of downhole tubulars 4, the debris that has collected at the closed end of the filter is flushed back into the well-bore. The filter 200 may therefore exhibit a self-cleaning function as a result of its orientation. By contrast, if the filter 200 were orientated with the closed end facing the string of downhole tubulars 4, debris would collect about the flange of the filter during back-flow. Reversal of the flow (i.e., toward the string of downhole tubulars 4) would then not be as effective at removing the debris from around the flange. The accumulation of debris may result in an increase in the pressure drop across the filter.

As described above, the hydraulic connector 10 may replace the traditional threaded connection between a top-drive 2 and string of downhole tubulars 4 during the removal or lowering of a string of downhole tubulars 4 from or into a well. Advantageously, the hydraulic connector permits a hydraulic connection between the top-drive 2 and the string of downhole tubulars 4 during tripping operations. As such, the hydraulic connector 10 may be used to more rapidly sealingly engage and disengage the string of downhole tubulars 4 without risk of damaging the threaded portions of either the top-drive 2 or the string of downhole tubulars 4.

Furthermore, the above-mentioned features provide a more versatile connector. Advantageously, the hydraulic connector may remain connected to the top-drive 2 when a direct (i.e., a torque transmitting) connection to the sting of downhole tubulars 4 is needed to turn the tubular 4. Rather than remove the entire hydraulic connector 10, the detachable shaft 105 may be quickly removed from the tubular rod 30 and the hydraulic connector 10 may engage directly with the drill string 4 by virtue of a threaded section 170 of threaded member 110 (FIG. 4*b*). By not having to disassemble and disengage hydraulic connector 10, time, and therefore rig costs, may be saved.

Advantageously, a hydraulic connector may provide a fluid tight connection between a fluid supply and a downhole tubular, including a body portion and an extendable portion, the extendable portion having a seal at or towards its free end which is adapted to selectively sealingly engage the downhole tubular; and a threaded portion provided on the body portion; the threaded portion being adapted to selectively engage with a threaded section of the downhole tubular; wherein the extendable portion extends through the threaded portion. The extendable portion may engage the downhole tubular when the extendable portion is at least partially extended from the body portion. The body portion may be a cylinder and the extendable portion may be a piston-rod. The connector may selectively connect to the downhole tubular via the threaded portion engaging with a corresponding threaded section inside the open end of the downhole tubular.

The seal may comprise a tapered bung adapted to be located in the open end of the downhole tubular. The seal may be detachable from the extendable portion. The extendable portion may be retractable within the threaded portion, so that the extendable portion may not be exposed beyond the end of the threaded portion. The extendable portion may be adapted to fit inside the interior of the downhole tubular beyond the threaded section in the open end of the downhole tubular. The extendable portion may be provided with a mechanical stop limiting the retraction of the extendable portion into the body portion. The extendable portion may be hollow and may provide a flow communication path between the fluid supply and the downhole tubular.

The threaded portion may be provided on a threaded member disposed about the extendable portion, and the threaded member may be detachable from the body portion. The threaded member may be threadably engaged with the body portion. The threaded member may be interchangeable with one or more alternative threaded members. The extendable portion may be provided with a formation such as a keyway and at least one of the body portion and the threaded member may be provided with a cooperating formation such as a corresponding keyway and/or a key. The key may interface with the keyway of the extendable portion so that rotation of the extendable portion with respect to the body portion may be prevented. The key and keyway may also provide a mechanical stop limiting the retraction of the extendable portion.

The extendable portion may be provided with splines and at least one of the body portion and the threaded member may be provided with corresponding splines. The splines on the extendable portion may engage with the corresponding splines, so that rotation of the extendable portion with respect to the body portion may be prevented. The splines may be straight and may be parallel to a longitudinal axis of the body portion. The splines may only be formed on a distal end of the extendable portion and/or on a distal end of the body portion.

The connector may be capable of transmitting torque from a top-drive to the downhole tubular via the threaded portion engaging with the threaded section of the downhole tubular. All threaded connections may be orientated in the same direction. The threaded portion may comprise a standard pin connection. The threaded section in the open end of the tubular may comprise a standard box connection. The extendable portion may comprise a filter. The downhole tubular may be a drill-string, a casing string or any other tubular for sending downhole.

Advantageously, a hydraulic connector may provide a fluid tight connection between a fluid supply and a downhole tubular including a body portion and an extendable portion, the extendable portion having a seal at or towards its free end which is adapted to selectively sealingly engage the downhole tubular; and wherein the seal is detachable from the extendable portion. The seal may be provided on a shaft and the shaft may be detachable from the extendable portion. The shaft may be threadably engaged with the extendable portion, for example with a stub-acme connection.

A connection between the extendable portion and the shaft may act as a sacrificial connection such that if an impact load is applied to the shaft, the extendable portion and body portion may be protected. The connection between the piston-rod and the shaft may be box weak. The shaft may be hollow. The seal may be interchangeable with one or more alternative seals. The connector may further comprise a threaded portion provided on the body portion and the threaded portion may be adapted to engage with a threaded section of the downhole tubular; wherein the extendable portion extends through the threaded portion.

Advantageously, a hydraulic connector may provide a fluid tight connection between a fluid supply and a downhole tubular, the connector comprising a body portion and an extendable portion, the extendable portion having a seal at or towards its free end which is adapted to sealingly engage the downhole tubular, wherein the extendable portion comprises a filter. The filter may be provided in the extendable portion. The seal may be detachable from the extendable portion and the seal may be provided on a shaft, the shaft being detachable from the extendable portion. The filter may comprise a flange which may be located between the detachable shaft and the extendable portion such that the filter may also be detachable from the shaft.

The filter may be substantially tubular, with a closed end and an open end. The open end of the tubular filter may be closest to the downhole tubular and the closed end of the tubular filter may be furthest from the downhole tubular. The closed end may be conical in shape. The filter may comprise a wire mesh. The filter may comprise a perforated tube. The filter may be self cleaning.

Advantageously, a kit of parts may include a connector, which provides a fluid tight connection between a fluid supply and a downhole tubular, the connector having an extendable portion and a body portion, the extendable portion being adapted to receive a seal at or towards its free end which is adapted to selectively sealingly engage the downhole tubular, and at least two removable and interchangeable seals of different dimensions.

A threaded portion may be provided on the body portion, and the threaded portion may be adapted to selectively engage with a threaded section in an open end of the downhole tubular. The threaded portion may be removable and interchangeable and the kit may further comprise at least two removable and interchangeable threaded portions of different dimensions.

Advantageously, a kit of parts may include a connector, which provides a fluid tight connection between a fluid supply and a downhole tubular, the connector having an extendable portion and a body portion, the body portion being adapted to receive a threaded portion, the threaded portion being adapted to selectively engage with a threaded section in an open end of the downhole tubular, and at least two removable and interchangeable threaded portions of different dimensions.

The extendable portion may be adapted to receive a seal at or towards its free end which is adapted to selectively sealingly engage the downhole tubular. The extendable portion may be removable and interchangeable and the kit may further comprise at least two removable and interchangeable seals of different dimensions. The threaded portions may have a different shape and/or size and/or thread. The extendable portion may extend through the threaded portion. The seals may have a different shape and/or size.

Advantageously, a method to provide a fluid tight connection between a fluid supply and a downhole tubular using a connection including an extendable portion and a body portion, the extendable portion having a seal at or towards its free end which is adapted to selectively sealingly engage the downhole tubular, and a threaded portion provided on the body portion, the threaded portion being adapted to selectively engage with a threaded section of the downhole tubular, may include engaging at least one of the seal and the threaded member with the downhole tubular.

The method may comprise exchanging the seal for a second seal. The method may comprise exchanging the threaded member for a second threaded member. The method may comprise swapping the engagement of the threaded member with the downhole tubular to an engagement of the seal with the downhole tubular. The method may comprise swapping the engagement of the seal with the downhole tubular to an engagement of the threaded member with the downhole tubular.

The method may comprise rotating the downhole tubular. The method may comprise the additional step of applying drilling fluid to the downhole tubular.

The extendable portion may extend through the threaded portion and at least one of the seal and the threaded member may be engaged in the open end of the downhole tubular. The connector may comprise a hydraulic ram, the body portion comprising the cylinder of the ram and the extendable portion comprising the piston of the ram.

To avoid unnecessary duplication of effort and repetition in the text, certain features are described in relation to only one or several aspects or embodiments of the disclosure. However, it is to be understood that, where it is technically possible, features described in relation to any aspect or embodiment of the disclosure may also be used with any other aspect or embodiment of the disclosure.

Furthermore, the mixing and matching of features, elements and/or functions between various embodiments is expressly contemplated herein so that one of ordinary skill in the art would appreciate from this disclosure that features, elements and/or functions of one embodiment may be incorporated into another embodiment as appropriate, unless described otherwise above. Moreover, many modifications may be made to adapt a particular situation or material to the teachings of the disclosure without departing from the essential scope thereof.

Therefore, while the disclosure has been presented with respect to a limited number of embodiments, those skilled in the art, having benefit of this disclosure, will appreciate that other embodiments may be devised which do not depart from the scope of the present disclosure. Accordingly, the scope of the disclosure should be limited only by the attached claims.

What is claimed is:

1. A hydraulic connector to provide a fluid tight connection between a fluid supply and a downhole tubular, the connector comprising:

an engagement assembly configured to extend and retract a seal assembly disposed at a distal end of the hydraulic connector into and from a proximal end of the downhole tubular;

a valve assembly operable between an open position and a closed position; and a threaded portion provided on a body of the hydraulic connector, the threaded portion configured to threadably engage a threaded section of the downhole tubular;

wherein the valve assembly is configured to allow the fluids to communicate between the fluid supply and the downhole tubular through the seal assembly when in the open position, wherein the valve assembly is configured to prevent fluid communication between the fluid supply and the downhole tubular when closed position, wherein an extendable portion of the seal assembly extends through the threaded portion, wherein at least one seal of the seal assembly is detachable from the extendable portion, and wherein the extendable portion is retractable within the threaded portion, so that the extendable portion is not exposed beyond the end of the threaded portion.

2. The hydraulic connector of claim 1, wherein the threaded portion threadably engages the downhole tubular inside a box threaded end of the downhole tubular.

3. The hydraulic connector of claim 1, wherein the extendable portion fits inside the interior of the downhole tubular beyond the threaded section in the proximal end of the downhole tubular.

4. The hydraulic connector of claim 1, wherein the extendable portion comprises a mechanical stop to limit the retraction of the extendable portion into the hydraulic connector.

5. The hydraulic connector of claim 1, wherein the extendable portion comprises a through bore to provide a flow communication path between the fluid supply and the downhole tubular.

6. The hydraulic connector of claim 1, wherein the threaded portion is provided on a threaded member disposed about the extendable portion, the threaded member being detachable from the hydraulic connector.

7. The hydraulic connector of claim 6, wherein the threaded member is interchangeable with one or more alternative threaded members.

8. The hydraulic connector of claim 1, wherein the extendable portion comprises a filter.

9. The hydraulic connector of claim 1, wherein the seal assembly comprises a tapered bung configured to seal inside the proximal end of the downhole tubular.

10. A hydraulic connector to provide a fluid tight connection between a fluid supply and a downhole tubular, the connector comprising:

an engagement assembly configured to extend and retract a seal assembly disposed at a distal end of the hydraulic connector into and from a proximal end of the downhole tubular;

a valve assembly operable between an open position and a closed position; and a threaded portion provided on a body of the hydraulic connector, the threaded portion configured to threadably engage a threaded section of the downhole tubular;

wherein the valve assembly is configured to allow the fluids to communicate between the fluid supply and the downhole tubular through the seal assembly when in the open position, wherein the valve assembly is configured to prevent fluid communication between the fluid supply and the downhole tubular when closed position, wherein an extendable portion of the seal assembly extends through the threaded portion, wherein the threaded portion is provided on a threaded member disposed about the extendable portion, the threaded member being detachable from the hydraulic connector, and wherein the threaded member is threadably engaged with a body portion of the hydraulic connector.

11. A hydraulic connector to provide a fluid tight connection between a fluid supply and a downhole tubular, the connector comprising:

an engagement assembly configured to extend and retract a seal assembly disposed at a distal end of the hydraulic connector into and from a proximal end of the downhole tubular;

a valve assembly operable between an open position and a closed position; and a threaded portion provided on a body of the hydraulic connector, the threaded portion configured to threadably engage a threaded section of the downhole tubular;

wherein the valve assembly is configured to allow the fluids to communicate between the fluid supply and the downhole tubular through the seal assembly when in the open position, wherein the valve assembly is configured to prevent fluid communication between the fluid supply and the downhole tubular when closed position, wherein an extendable portion of the seal assembly extends through the threaded portion, wherein the threaded portion is provided on a threaded member disposed about the extendable portion, the threaded member being detachable from the hydraulic connector, and wherein the extendable portion comprises a keyway configured to receive a key and to prevent rotation of the extendable portion with respect to remainder of the hydraulic connector.

12. A hydraulic connector to provide a fluid tight connection between a fluid supply and a downhole tubular, the connector comprising:

an engagement assembly configured to extend and retract a seal assembly disposed at a distal end of the hydraulic connector into and from a proximal end of the downhole tubular;

a valve assembly operable between an open position and a closed position; and a threaded portion provided on a body of the hydraulic connector, the threaded portion configured to threadably engage a threaded section of the downhole tubular;

wherein the valve assembly is configured to allow the fluids to communicate between the fluid supply and the downhole tubular through the seal assembly when in the open position, wherein the valve assembly is configured to prevent fluid communication between the fluid supply and the downhole tubular when closed position, wherein an extendable portion of the seal assembly extends through the threaded portion, and wherein the hydraulic connector is configured to transmit torque from a top-drive to the downhole tubular via the threaded portion engaging with the threaded section of the downhole tubular.

13. A hydraulic connector to provide a fluid tight connection between a fluid supply and a downhole tubular, the connector comprising:

a body portion;

an extendable portion reciprocable with respect to the body portion;

a seal assembly at a distal end of the extendable portion;

locking teeth of the body portion; and corresponding teeth of the extendable portion;

wherein the seal assembly is configured to sealingly engage the downhole tubular, wherein the seal assembly is detachable from the extendable portion, and wherein the locking teeth and the corresponding teeth are configured to restrict rotation of the extendable portion when the extendable portion is in a retracted position with respect to the body portion.

14. The hydraulic connector of claim 13, wherein the seal assembly comprises a seal on a shaft, the shaft being detachable from the extendable portion.

15. The hydraulic connector of claim 14, wherein the shaft is threadably engaged with the extendable portion.

16. The hydraulic connector of claim 14, further comprising a sacrificial connection between the extendable portion and the shaft to protect the extendable portion and the body portion in the event of an impact load.

17. The hydraulic connector of claim 14, wherein the shaft comprises a through bore.

18. The hydraulic connector of claim 13, wherein the seal assembly is interchangeable with one or more alternative seal assemblies.

19. The hydraulic connector of claim 13, wherein the connector further comprises a threaded portion provided on the body portion; the threaded portion being adapted to engage with a threaded section of the downhole tubular;

wherein the extendable portion extends through the threaded portion.

20. The hydraulic connector of claim 13, wherein the seal assembly comprises at least two removable and interchangeable seals of different dimensions.

21. A hydraulic connector to provide a fluid tight connection between a fluid supply and a downhole tubular, the connector comprising:

a body portion;

an extendable portion recriprocable with respect to the body portion; and a seal assembly at a distal end of the extendable portion;

wherein the seal assembly is configured to sealingly engage the downhole tubular, wherein the seal assembly is detachable from the extendable portion, wherein the extendable portion further comprises a filter, and wherein the filter comprises a flange located between a detachable shaft and the extendable portion.

22. A hydraulic connector to provide a fluid tight connection between a fluid supply and a downhole tubular, the connector comprising:

a body portion;

an extendable portion recriprocable with respect to the body portion; and a seal assembly at a distal end of the extendable portion;

wherein the seal assembly is configured to sealingly engage the downhole tubular, wherein the seal assembly is detachable from the extendable portion, wherein the extendable portion further comprises a filter, and wherein the filter is substantially tubular and comprises a closed end and an open end.

23. A method to provide a fluid tight connection between a fluid supply and a downhole tubular using a hydraulic connector, the method comprising:

disposing a seal assembly upon a distal end of a piston-rod assembly;

increasing a pressure of fluids in the fluid supply;

extending the piston-rod assembly;

engaging the seal assembly within a proximal end of the downhole tubular;

engaging at least one of the seal assembly and a threaded member within a proximal end of the downhole tubular; and transmitting torque between the fluid supply and the downhole tubular.

24. The method of claim 23, further comprising hydraulically communicating fluids between the fluid supply and the downhole tubular.

25. The method of claim 23, wherein the fluid supply comprises at least one of a top-drive assembly, a rotating swivel, and downhole tubular.

26. The method of claim 23, further comprising exchanging the threaded member for a second threaded member.

27. A method to provide a fluid tight connection between a fluid supply and a downhole tubular using a hydraulic connector, the method comprising:

disposing a seal assembly upon a distal end of a piston-rod assembly;

increasing a pressure of fluids in the fluid supply;

extending the piston-rod assembly;

engaging the seal assembly within a proximal end of the downhole tubular;

engaging at least one of the seal assembly and a threaded member within a proximal end of the downhole tubular; and restricting rotation of the piston-rod assembly with respect to a body of the hydraulic connector when the piston-rod assembly is in a retracted position.

* * * * *